US007788960B2

(12) United States Patent
Petkovsek et al.

(10) Patent No.: US 7,788,960 B2
(45) Date of Patent: Sep. 7, 2010

(54) MULTI-WALLED TUBE AND METHOD OF MANUFACTURE

(75) Inventors: Robert Raymond Petkovsek, Neillsville, WI (US); Louis Hagedorn, Neillsville, WI (US)

(73) Assignee: Cummins Filtration IP, Inc., Minneapolis, MN (US)

( * ) Notice: Subject to any disclaimer, the term of this patent is extended or adjusted under 35 U.S.C. 154(b) by 823 days.

(21) Appl. No.: 11/588,803

(22) Filed: Oct. 27, 2006

(65) Prior Publication Data

US 2008/0169489 A1 Jul. 17, 2008

(51) Int. Cl.
*B21D 3/00* (2006.01)

(52) U.S. Cl. ..... 72/367.1; 72/368; 72/370.1; 72/370.11

(58) Field of Classification Search ..... 72/84, 72/267, 347, 348, 352, 367.1, 368, 369, 370.03, 72/370.1, 370.11; 29/890.053
See application file for complete search history.

(56) References Cited

U.S. PATENT DOCUMENTS

| | | | | | |
|---|---|---|---|---|---|
| 2,884,886 | A * | 5/1959 | Jonsson | 72/329 |
| 2,982,329 | A * | 5/1961 | Batcheller | 72/412 |
| 3,129,505 | A * | 4/1964 | Cox | 228/151 |
| 3,146,014 | A * | 8/1964 | Kroell | 293/133 |
| 3,339,674 | A * | 9/1967 | Kroell et al. | 188/374 |
| 3,706,292 | A * | 12/1972 | Saunders | 72/335 |
| 3,851,517 | A * | 12/1974 | Greenleaf | 72/352 |
| 4,466,566 | A * | 8/1984 | Good | 228/155 |
| 4,854,149 | A * | 8/1989 | Porucznik et al. | 72/352 |
| 5,170,557 | A | 12/1992 | Rigsby | |
| 5,363,544 | A | 11/1994 | Wells et al. | |
| 5,475,911 | A | 12/1995 | Wells et al. | |
| 5,673,490 | A | 10/1997 | Hill | |
| 5,836,065 | A | 11/1998 | Dehlinger et al. | |
| 5,866,949 | A | 2/1999 | Schueller | |
| 5,990,545 | A | 11/1999 | Schueller et al. | |
| 6,505,490 | B2 * | 1/2003 | Hodjat et al. | 72/84 |
| 6,586,834 | B1 | 7/2003 | Sze et al. | |
| 6,715,581 | B2 | 4/2004 | Dooley | |
| 6,825,108 | B2 | 11/2004 | Khan et al. | |
| 6,876,553 | B2 | 4/2005 | Zhao et al. | |
| 6,887,741 | B2 | 5/2005 | Zhao et al. | |
| 7,005,737 | B2 | 2/2006 | Zhao et al. | |
| 7,038,312 | B2 | 5/2006 | Khan et al. | |
| 7,078,806 | B2 | 7/2006 | Khan et al. | |
| 2005/0173787 | A1 | 8/2005 | Zhao et al. | |
| 2006/0065972 | A1 | 3/2006 | Khan et al. | |
| 2008/0314112 | A1 * | 12/2008 | Park et al. | 72/347 |

FOREIGN PATENT DOCUMENTS

WO WO 2004/097896 A2 11/2004

* cited by examiner

*Primary Examiner*—Edward Tolan
(74) *Attorney, Agent, or Firm*—Krieg DeVault LLP; J. Bruce Schelkopf, Esq.

(57) ABSTRACT

A method of forming multi-wall tube from a single-wall piece of tube. The multi-wall tube is formed by relative motion between a die shoe and the single-wall tube to deform the material.

16 Claims, 6 Drawing Sheets

MULTI-WALLED TUBE AND METHOD OF MANUFACTURE

BACKGROUND

The present invention relates generally to a method of producing a multi wall tube from a single wall tube. More specifically, in one form the present invention relates to forming a dual wall tube from a piece of single wall tube.

Traditional methods of producing dual wall tubes generally utilize two separate tubes that are coaxial. These traditional methods include: forming both tubes at the same time, forming the outer tube as two separate pieces and welding around the inner tube and bending two tubes of similar diameter to the desired configuration and then hydroforming the outer tube and/or the inner tube to obtain the desired size(s).

While the traditional methods are appropriate for producing multi wall tubes they have a variety of shortcomings, drawbacks and disadvantages. Accordingly, there is a need for the unique and inventive method of manufacturing a multi wall tube according to the present invention.

SUMMARY

In a first embodiment of the present invention there is disclosed a method of making a dual wall tube from a single-wall piece of tube with a first wall having an inner surface and an outer surface extending between a first end and a second end. The method comprises engaging the first end of the single-wall piece of tube with the forming surface of a die shoe. The method further comprises moving the first end of the single-wall tube relative to the forming surface of the die shoe to form a curl until the first end of the tube substantially contacts one of the inner surface and the outer surface of the first wall. The method also comprises continuing to move the single-wall tube relative to the forming surface of the die shoe to form a second wall as the first end traverses along at least a portion of the one of the inner surface and the outer surface of the first wall.

In one refinement of the first embodiment in the engaging and the moving and the continuing there is relative movement between the single-wall tube and the forming surface of the die.

In another refinement of the first embodiment at least one of the moving and the continuing the single-wall tube is moved relative to the die shoe.

In another refinement of the first embodiment the moving and the continuing involve driving the single-wall tube through the die shoe.

In another refinement of the first embodiment at least one of the moving and the continuing the die shoe is moved relative to the single-wall tube.

In another refinement of the first embodiment the moving and the continuing involve driving the die shoe along at least a portion of the single-wall tube.

In another refinement of the first embodiment the moving the continuing utilizes pressure to cause relative motion between the single-wall tube and the die shoe.

In another refinement of the first embodiment the moving and the continuing involve driving the single-wall tube through the die shoe.

In another refinement of the first embodiment the pressure exerted is substantially constant as the first end of the tube is driven through the forming surface of the die shoe to form a curl.

In another refinement of the first embodiment the pressure exerted as the first end traverses along the one of the inner surface and the outer surface of the first wall is substantially constant.

In another refinement of the first embodiment the first end of the tube substantially contacts the outer surface of the first wall and the curl is an exterior curl.

In another refinement of the first embodiment the first end of the tube is flared outward prior to the engaging.

In another refinement of the first embodiment the first end traverses the entire length of the outer surface of the first wall to the second end.

In another refinement of the first embodiment the first end traverses only a portion of the length of the outer surface of the first wall and stops short of the second end.

In another refinement of the first embodiment the first end of the tube contacts the inner surface of the first wall and the curl is an interior curl.

In another refinement of the first embodiment the first end of the tube is flared inward prior to the engaging.

In another refinement of the first embodiment the first end traverses the entire length of the inner surface of the first wall to the second end.

In another refinement of the first embodiment the pressure exerted as the first end of the tube is driven through the forming surface of the die shoe to form a curl is about equal to the pressure exerted as the first end traverses along the one of the inner surface and the outer surface of the first wall.

In another embodiment of the present invention there is a single piece construction double-wall tube having a first end held substantially concentric by a lip portion between an interior wall and an exterior wall such that at the first end an inner surface of the interior wall becomes an outer surface of the exterior wall.

In one refinement of this embodiment the lip portion is an arcuate curve extending over approximately 180 degrees.

In another refinement of this embodiment the interior wall is integral with the exterior wall at the first end.

In another refinement of this embodiment the tube has a second end joining the interior and exterior walls, the join being a contact join by a curled portion of one of the interior wall and the exterior wall.

In another refinement of this embodiment the curl is an exterior curl.

In another refinement of this embodiment the curl is an interior curl.

In another refinement of this embodiment there is an apparatus comprising multiple pieces of the double-wall tube, at least some of the multiple pieces being joined to one another by an elbow.

DESCRIPTION OF THE ILLUSTRATIVE EMBODIMENTS

Figure 1:
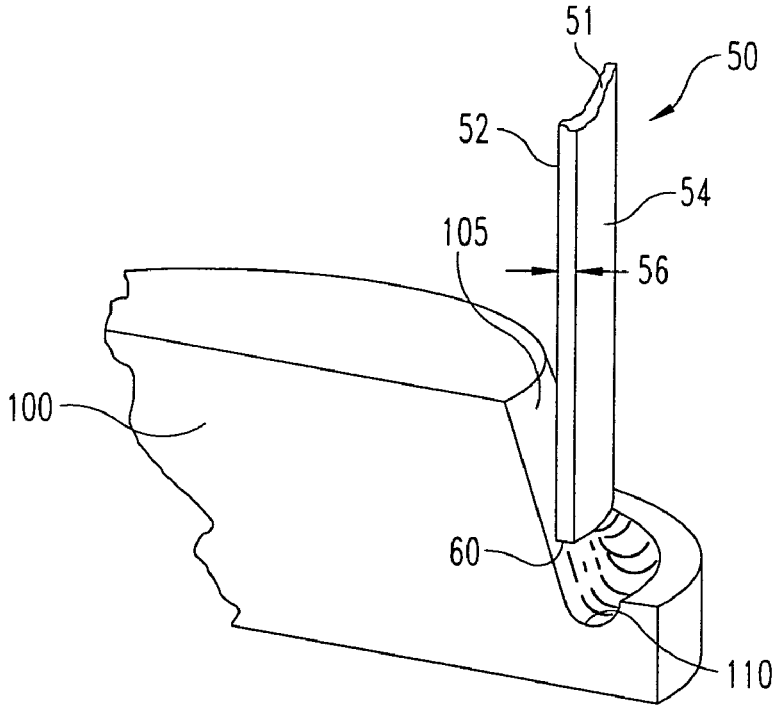
FIG. 1 is a cross-sectional view of a first embodiment of the invention as a single-wall tube enters the die shoe.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present invention relates generally to a method of manufacturing dual wall tube from a single-wall piece of tube. Double or multi-walled tube preferably includes an intervening gap. In one form the intervening gap is an air gap associated with heat transfer purposes, however the present invention is not limited to the intervening gap being an air gap. Such double or multi-walled tube finds use in, for example, various automotive applications such as exhaust piping. In the most general of terms, one embodiment of the method of the present invention entails the relative movement between a single wall piece of tubing and forming die to create a dual wall tube.

Figure 2:
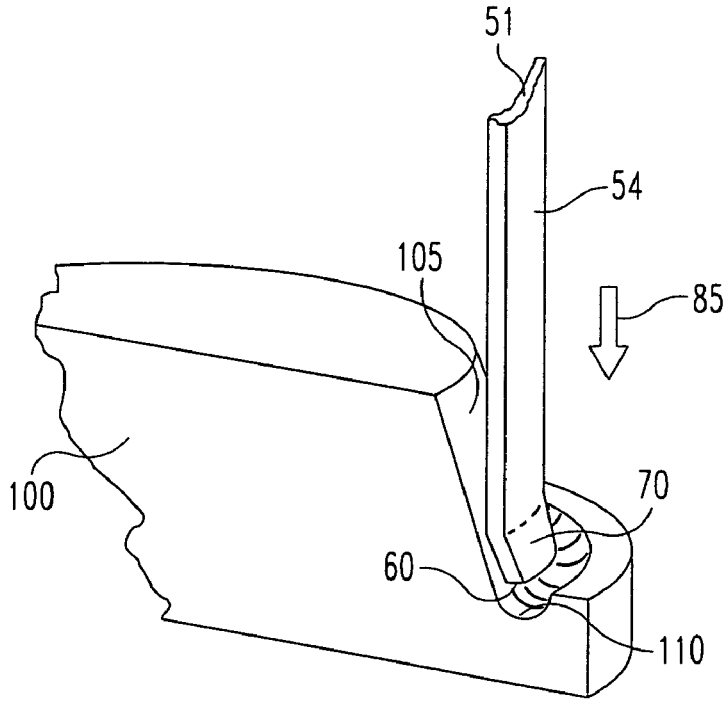
FIG. 2 is a cross-sectional view of the invention of FIG. 1 illustrating the point in time as pressure is applied and the single wall tube initially bends.

With reference to FIGS. 1-5 there are illustrated aspects of a first embodiment of the present invention. With reference to FIG. 1 there is illustrated a single wall piece of tube 50. Only a portion of the single wall piece of tube 50 has been illustrated, however the reader should understand that in one preferred form the tube 50 has a cylindrical configuration. However, other geometric cross sections including, but not limited to, elliptical are contemplated herein. Tube 50 has a wall 51 with a thickness 56 between inner surface 52 and outer surface 54. The first end 60 of tube 50 is illustrated as it enters die shoe 100 (preferably substantially adjacent tapered leading surface 105) and approaches forming surface 110. With reference to FIG. 2 there is illustrated a later point in time. Pressure is applied to move wall 51 downward as indicated by arrow 85, and the first end 60 of tube 50 begins to deform, creating a circumferential flat 70. The formation of the double wall tube from the single-wall tube is directly associated with the relative motion between the single-wall tube and the die shoe 100. The die shoe 100 may also be moved in a direction opposite to arrow 85 to engage the first end 60 of tube 50 to cause deformation. In another embodiment the die shoe 100 and the tube 50 may both be moved to cause relative motion between them and deformation of the first end 60.

Figure 3:
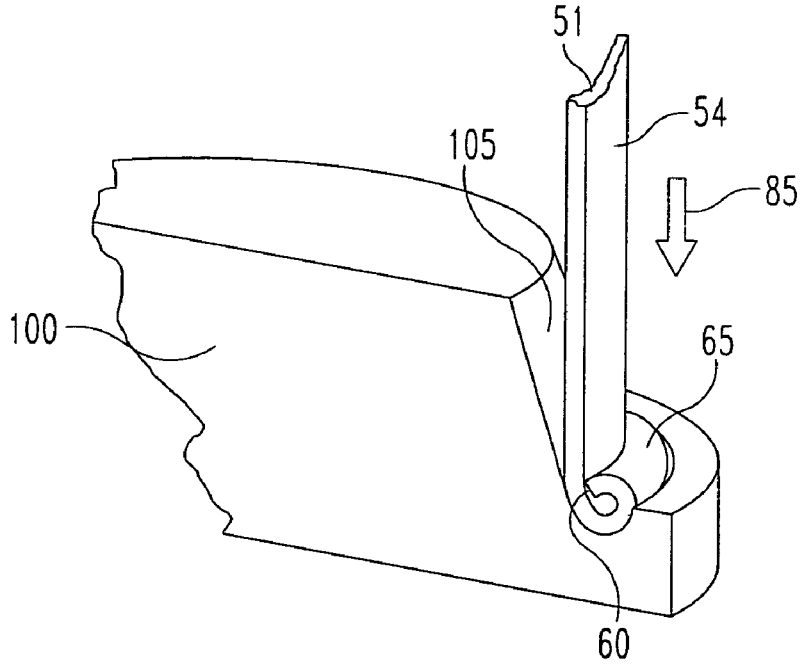
FIG. 3 is a cross-sectional view of the invention of FIG. 1 illustrating the continuing application of pressure from FIG. 2 and the formation of a curl.

With reference to FIG. 3, there is illustrated a later point in time in the process of forming the dual wall tube. In one form a substantially constant pressure is exerted such that the first end 60 of tube 50 is driven through forming surface 110 of die shoe 100 to form a curl 65. This substantially constant pressure is preferably continued until first end 60 contacts outer surface 54 of wall 51. Alternatively, the first end 60 might simply substantially contact outer surface 54 of wall 51. That is to say, first end 60 preferably might directly contact outer surface 54, or first end 60 might instead curl even further such that while the curl 65 would still join walls 51 and 81, the first end 60 might not directly contact the outer surface 54. The present invention is not limited to a substantially constant pressure unless specifically provided to the contrary.

Figure 4:
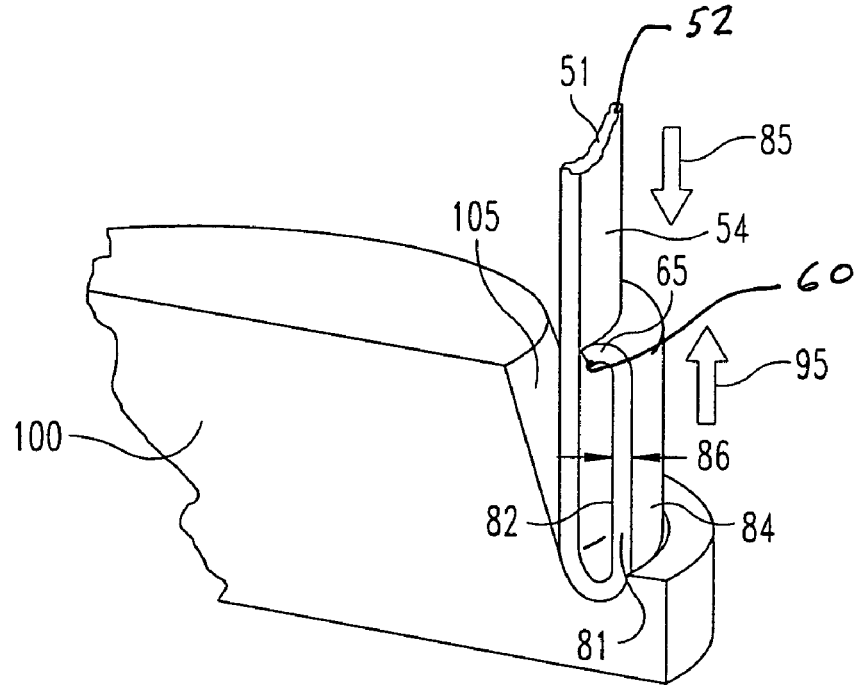
FIG. 4 is a cross-sectional view of the invention of FIG. 1 illustrating the continuing application of pressure from FIG. 3 as the single wall tube progresses to form a double-wall tube.

With reference to FIG. 4, there is illustrated an even later point in time in the process of forming the dual wall tube. Under continuing pressure the portion of material of tube 50 that has passed through the curve defined by forming surface 110 progresses upward as indicated by arrow 95. That is to say, after the curl 65 is formed, the material adjacent to curl 65 begins to push the curl 65 upward along the outer surface 54 of wall 51. Consequently, a portion of the inner surface 52 of wall 51 becomes the outer surface 84 of the second (exterior) wall 81. Similarly, a portion of the outer surface 54 of wall 51 becomes the inner surface 82 of the exterior wall 81.

Consequently, first and second walls 51 and 81 are formed in tube 50 that previously merely had a single-wall 51. In other words, the result is a single-piece construction double-wall tube with one end being held concentric by the curl and the other end joining the inner and outer walls by the contact of first end 60 against the outer surface 54 of interior wall 51. The inner wall 51 of tube 50 has the original thickness 56 and the outer wall 81 has a thickness 86. The thickness 86 depends on various factors such as the size of the air gap and original diameter of the tube. The reader should readily appreciate that the thickness 86 will be less than the thickness 56.

Figure 5:
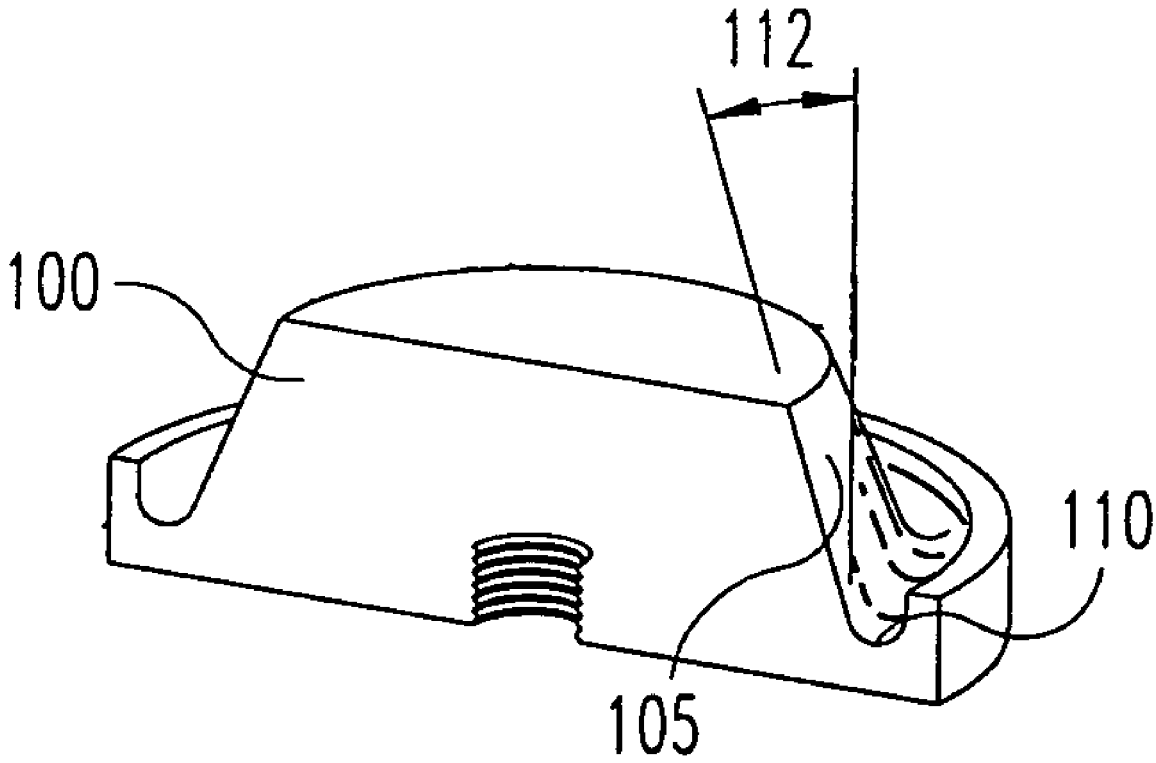
FIG. 5 is a cross-sectional view of the invention of FIG. 1 illustrating the die shoe in the absence of any tube.

With reference to FIG. 5, there is illustrated the die shoe 100 in the absence of a tube 50. Die shoe 100 has a preferably tapered leading surface 105 that the first end 60 of tube 50 contacts and slides along. Leading surface 105 is adjacent to the preferably curved forming surface 110 of die shoe 100. Leading surface 105 is preferably tapered at an angle 112 as indicated in FIG. 5. In one embodiment, the angle 112 of the taper is about 10 degrees for tapering down to initiate curling of the first end 60 of the tube 50. The present invention includes a wide variety of angles and is not limited to an angle of about 10 degrees. In another form of the invention the invention the angle is within a range of two degrees to ten degrees.

In one form of the present invention the tube is a single piece of tubing having a length within a range of about three to five feet. The tubing is worked at a rate of about 100 inches/minute. However, the present application is not limited to this specific example and other processing rates and tube lengths are contemplated herein.

Figure 6:
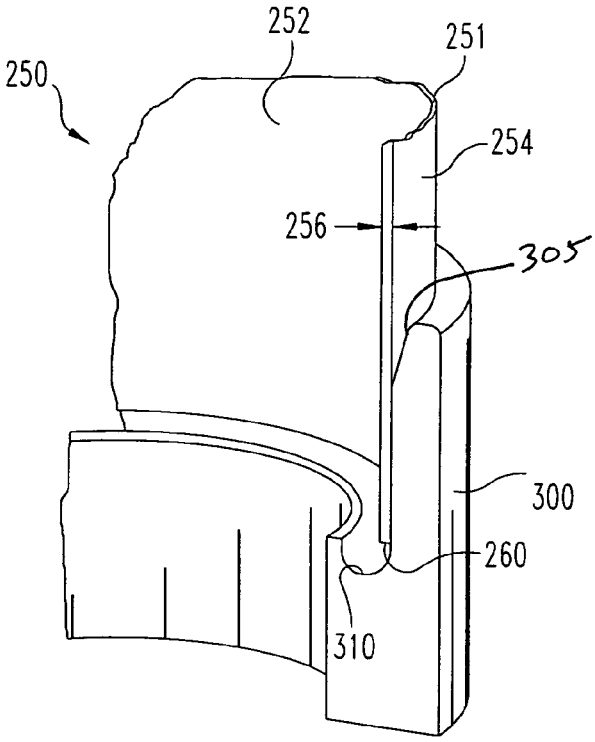
FIG. 6 is a cross-sectional view of a second embodiment of the invention as a single-wall tube enters the die shoe.
Figure 7:
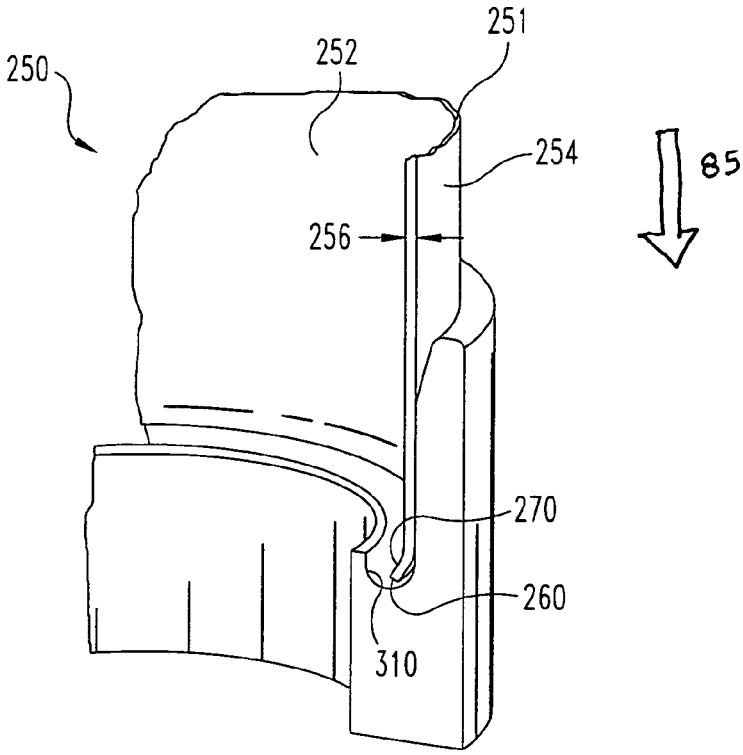
FIG. 7 is a cross-sectional view of the invention of FIG. 6 illustrating the point in time as pressure is applied and the single wall tube initially deforms.

With reference to FIGS. 6-10 there are illustrated aspects of a second embodiment of the present invention. With reference to FIG. 6 there is illustrated a single wall piece of tube 250. Only a portion of the single wall piece of tube 250 has been illustrated, however the reader should understand that in one preferred form the tube 250 has a cylindrical configuration. However, other geometric cross sections including, but not limited to, elliptical are contemplated herein. Tube 250 has a wall 251 with a thickness 256 between inner surface 252 and outer surface 254. The first end 260 of tube 250 is illustrated as it enters die shoe 300 (preferably substantially adjacent leading surface 305) and approaches forming surface 310. With reference to FIG. 7 there is illustrated a later point in time. Pressure is applied to move wall 251 downward, and the first end 260 of tube 250 begins to deform, creating a circumferential flat 270. The die shoe 300 may also be moved in a direction opposite to arrow 85 to engage the first end 260 of tube 250 to cause deformation. In another embodiment the die shoe 300 and the tube 250 may both be moved to cause relative motion between them and deformation of first end 260. The formation of the double wall tube from the single-wall tube is directly associated with the relative motion between the single-wall tube and the die shoe 300.

Figure 8:
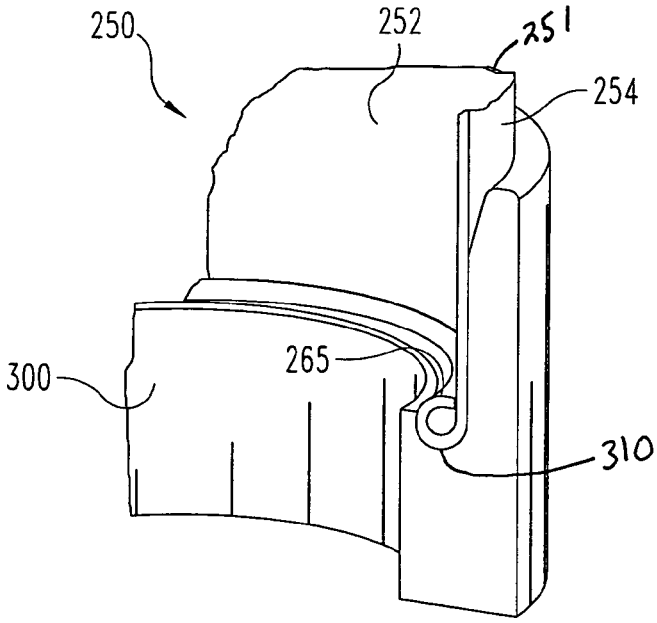
FIG. 8 is a cross-sectional view of the invention of FIG. 6 illustrating the continuing application of pressure from FIG. 7 and the formation of a curl.

With reference to FIG. 8, there is illustrated a later point in time in the process of forming the dual wall tube. In one form a substantially constant pressure is exerted such that the first end 260 of tube 250 is driven through forming surface 310 of die shoe 300 to form a curl 265. This substantially constant pressure is preferably continued until first end 260 contacts inner surface 252 of wall 251. Alternatively, the first end 260 might simply substantially contact inner surface 252 of wall 251. That is to say, first end 260 preferably might directly contact inner surface 252, or first end 260 might instead curl even further such that while the curl 265 would still join walls 251 and 281, the first end 260 might not directly contact the inner surface 252. The present invention is not limited to a substantially constant pressure unless specifically provided to the contrary.

Figure 9:
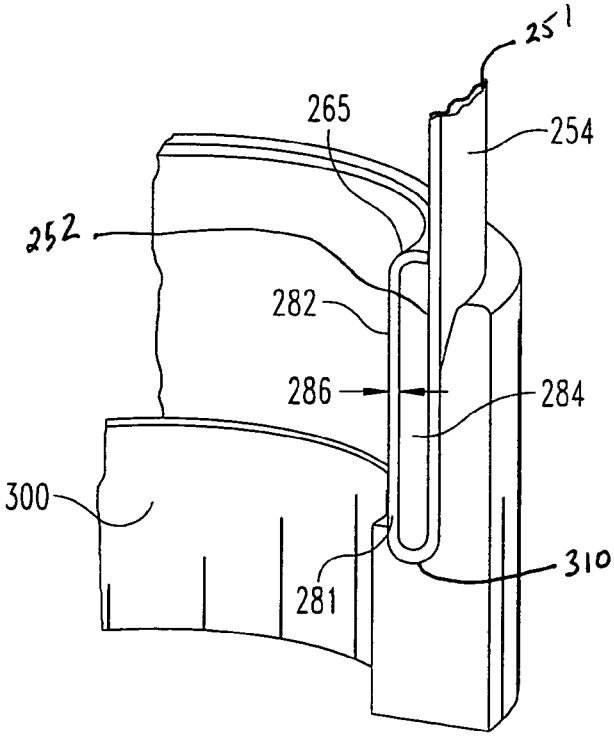
FIG. 9 is a cross-sectional view of the invention of FIG. 6 illustrating the continuing application of pressure from FIG. 8 as the single wall tube progresses to form a double-wall.

With reference to FIG. 9, there is illustrated an even later point in time in the process of forming the dual wall tube. Under continuing pressure the portion of material of tube 250 that has passed through the curve of forming surface 310 progresses upward. That is to say, after the curl 265 is formed, the material adjacent to curl 265 begins to push the curl 265 upward along the inner surface 252 of wall 251. Consequently, a portion of the inner surface 252 of wall 251 becomes the outer surface 284 of the second (interior) wall 281. Similarly, a portion of the outer surface 254 of wall 251 becomes the inner surface 282 of the interior wall 281.

Consequently, first and second walls 251 and 281 are formed in tube 250 that previously merely had a single-wall 251. In other words, the result is a single-piece construction double-wall tube with one end being held concentric by the curl and the other end joining the inner and outer walls by the contact of first end 260 against the inner surface 252 of wall 251. The outer wall 251 of tube 250 has the original thickness 256 and the inner wall 281 has a thickness 286. The thickness 286 depends on various factors such as the size of the air gap and original diameter of the tube. The reader should readily appreciate that the thickness 286 will be less than the thickness 256.

Figure 10:
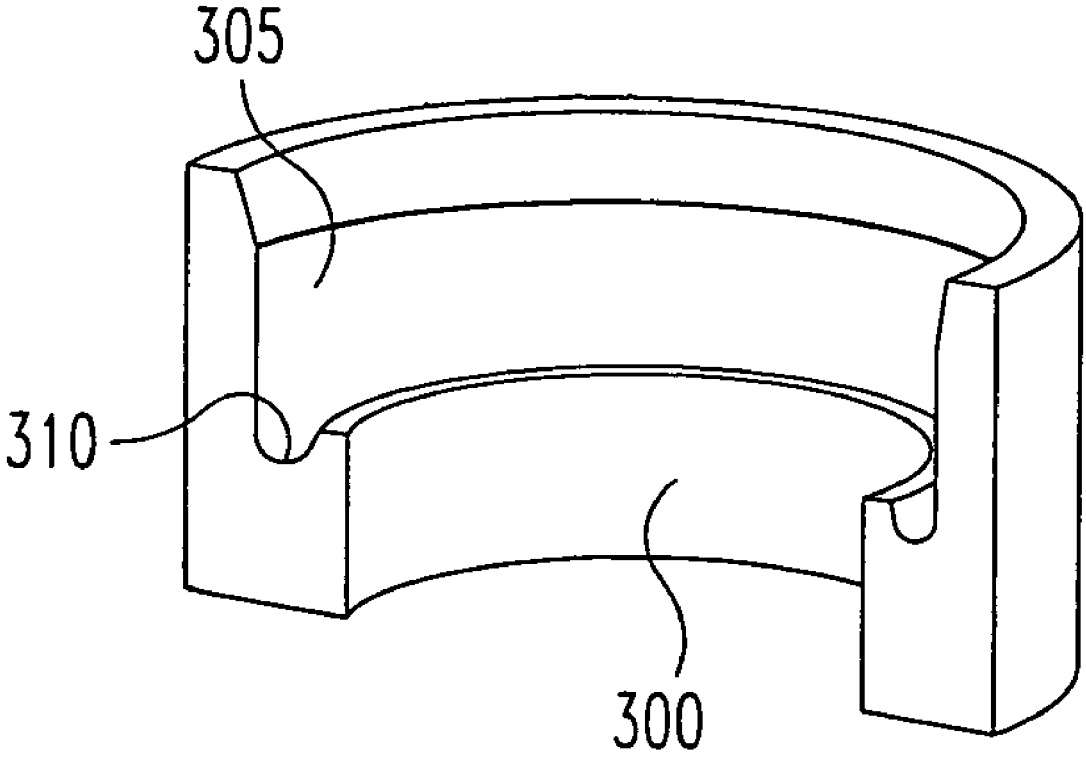
FIG. 10 is a cross-sectional view of the invention of FIG. 6 illustrating the die shoe in the absence of any tube.

With reference to FIG. 10, there is illustrated the die shoe 300 in the absence of a tube 250. Die shoe 300 has a leading surface 305 that the first end 260 of tube 250 contacts and slides along. Leading surface 305 is adjacent to the preferably curved forming surface 310 of die shoe 300. While not shown, leading surface 305 might be tapered at an angle. The angle of the inward taper of the second embodiment of the die shoe 300 of FIG. 10 might preferably be similar to the taper of 10 degrees of the first embodiment of the die shoe 100 of FIG. 5, to best initiate curling of the first end 260 of the tube 250. The present invention includes a wide variety of angles and is not limited to an angle of about 10 degrees. In another form of the invention the angle is within a range of two degrees to ten degrees.

It will be understood by those of ordinary skill in the art that the length of the outer wall 81 (FIGS. 1-5) of the dual walls can be stopped short of the second end (not shown) of inner wall 51. Stopping short of the second end (not shown) might be useful, for example, to permit additional end treatments, such as outdents or flares. Similarly, it will also be understood by those of ordinary skill in the art that in the embodiment having an interior curl (FIGS. 6-10), the length of the inner wall 281 of the dual walls can be stopped short of the second end (not shown) of outer wall 251

For forcing the tube through the die, downward pressure is illustrated in FIGS. 1-4 (arrow 85) and FIGS. 6-9. The present application clearly contemplates the movement of the tube into the stationary die and the movement of both the tube and the die. It should be understood that it is contemplated as within the scope of the invention that while alignment of the tube and die shoe is preferably as illustrated, other alignments are contemplated as within the scope of the invention. For example the alignment may be such as to provide upwardly directed pressure, or even at an angle of zero to ninety degrees from the vertical.

There has been reduction to practice of the exterior curl method of manufacture of the present invention including a wide variety of sizes and curl diameters. For example, one dual wall tube of about a 16 inch diameter was formed from a single-wall tube with about a 14 inch outer diameter and a 1 inch exterior curl. As a rule of thumb, the diameter of the curl is 4.5 times the metal thickness of the single-wall tube or larger. As yet another example, in one application of the present invention a 48 inch long single-wall tube was forced through an exterior curl die resulting in a double-walled tube approximately 23 inches long.

There has been reduction to practice of the interior curl method of manufacture of the present invention including a wide variety of sizes and curl diameters. For example, one dual wall tube having about a 10 inch outer diameter was formed from was formed from a single-wall tube with a 10 inch outer diameter and about a 1 inch diameter curl with a resulting 8 inch inner diameter tube.

As should be apparent from the description above, the embodiment of the invention illustrated in FIGS. 1 through 5 demonstrates the application of the method of the present invention in forming an exterior curl. In contrast, the embodiment of the invention illustrated in FIGS. 6 through 10 demonstrates the application of the method of the present invention in forming an interior curl. It should be understood that the sizing discussed above with respect to the embodiment of FIGS. 1-5 and the embodiment of FIGS. 6-10 are merely exemplary. A wide variety of other sizes are contemplated as within the scope of the invention.

In one preferred application of the method of the present invention, an exterior curl is preferably formed using a single-wall tube that has been subject to flaring slightly before entering the curling portion of the die. Flaring of the single-wall tube appears to enable smaller curl diameters.

With respect to component materials, the methods of the present invention have been applied to construct double-wall tube from single-wall tube made of, for example, 409 stainless steel. A wide variety of other materials, such as various other stainless steels known to those of ordinary skill in the art, are contemplated as within the scope of the invention. It should be understood that such materials are selected so as to possess the needed wall strength to push the tube through the die and have the wall resist buckling from applied forces, including those of the curled end.

It will be understood by those of ordinary skill in the art that the double-walled tube of the present invention may be used in manufacturing of a completed product with curves therein, such as exhaust piping. It will further be understood that the individual sections of straight dual wall tube produced according to the present invention are preferably joined together with, for example, single-wall elbows to make any final 'bent' formed product, such as exhaust piping.

Additionally, the methods of the present invention preferably permit reduction of the manufacturing time. For example, the method of the present invention permits manufacturing of double-walled tube of multiple feet in length in less than one minute compared to an expected manufacturing time of fifteen to twenty minutes using some of the more traditional methods of manufacture. Moreover, the methods of the present invention appear to provide double-wall tube that might have greater strength and/or resilience to, for example, the hostile environment encountered in exhaust piping of an internal combustion engine. The double-wall tube of the present invention does not possess a join or similar potential failure point extending for most of the length of the tube, as is the case when inner and outer tubes are welded together in more traditional methods of manufacturing double-wall tube.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A method of making dual-wall tubes from single-wall pieces of tube, comprising:

providing a first piece of tube having a single wall with an inner surface and an outer surface extending between a first end and a second end;

engaging the first end of the first piece of tube with a forming surface of a die shoe;

moving the first end of the first piece of tube relative to the forming surface of the die shoe to form a curl until the first end of the first piece of tube substantially contacts one of the inner surface and the outer surface;

continuing to move the first piece of tube relative to the forming surface of the die shoe to form a second wall as the first end traverses along at least a portion of the one of the inner surface and the outer surface;

disengaging the first piece of tube from the die shoe to provide a first dual-wall tube;

providing a second piece of tube having a single wall with a second piece inner surface and a second piece outer surface extending between a second piece first end and a second piece second end;

engaging the second piece first end with the forming surface of the die shoe;

moving the second piece first end relative to the forming surface of the die shoe to form a second piece curl until the second piece first end contacts one of the second piece inner surface and the second piece outer surface;

continuing to move the second piece of tube relative to the forming surface of the die shoe to form a second piece second wall as the second piece first end traverses along at least a portion of the one of the second piece inner surface and the second piece outer surface; and disengaging the second piece of tube from the die shoe to provide a second dual-wall tube.

2. The method of claim 1, wherein in said engaging and said moving and said continuing there is relative movement between the single-wall tube and the forming surface of the die.

3. The method of claim 1, wherein in at least one of said moving and said continuing the single-wall tube is moved relative to the die shoe.

4. The method of claim 1, wherein said moving and continuing involve driving the single-wall tube through the die shoe.

5. The method of claim 1, wherein in at least one of said moving and said continuing the die shoe is moved relative to said single-wall tube.

6. The method of claim 1, wherein said moving and said continuing involve driving the die shoe along at least a portion of the single-wall tube.

7. The method of claim 1, wherein said moving and continuing utilize pressure to cause relative motion between the single-wall tube and the die shoe.

8. The method of claim 7, wherein said moving and said continuing involve driving the single-wall tube through the die shoe.

9. The method of claim 8, wherein the pressure exerted is substantially constant as the first end of the tube is driven through the forming surface of the die shoe to form a curl.

10. The method of claim 8, wherein the pressure exerted as the first end traverses along the one of the inner surface and the outer surface of the first wall is substantially constant.

11. The method of claim 1, wherein the first end of the tube substantially contacts the outer surface of the first wall and the curl is an exterior curl.

12. The method of claim 11, wherein the first end of the tube is flared outward prior to said engaging.

13. The method of claim 1, wherein the first end traverses the entire length of the outer surface of the first wall to the second end.

14. The method of claim 1, wherein the first end of the tube contacts the inner surface of the first wall and the curl is an interior curl.

15. The method of claim 14, wherein the first end of the tube is flared inward prior to said engaging.

16. The method of claim 9, wherein the pressure exerted as the first end of the tube is driven through the forming surface of the die shoe to form a curl is about equal to the pressure exerted as the first end traverses along the one of the inner surface and the outer surface of the first wall.

* * * * *